United States Patent [19]

LaConte

[11] 4,185,415

[45] Jan. 29, 1980

[54] ARTICULATED HINGE COOPERATING WITH AN ENERGY STORAGE DEVICE CAPABLE OF AUTOMATICALLY OPENING AND HOLDING OPEN AN UNLATCHED COMPARTMENT DOOR

[75] Inventor: Richard J. LaConte, Auburn, Wash.

[73] Assignee: The Boeing Company, Seattle, Wash.

[21] Appl. No.: 896,398

[22] Filed: Apr. 14, 1978

[51] Int. Cl.[2] ..... E05D 15/40; E05F 1/10

[52] U.S. Cl. ..... 49/248; 49/379; 49/386; 220/333

[58] Field of Search ..... 49/386, 246, 248, 249, 49/379, 339, 340, 344, 345; 16/179, 180; 220/331, 333

[56] References Cited

U.S. PATENT DOCUMENTS

| | | | |
|---|---|---|---|
| 2,579,091 | 12/1951 | Rinaldo | 16/180 UX |
| 2,790,887 | 4/1957 | Gelfand | 49/246 X |
| 2,882,004 | 4/1959 | Leishman | 220/333 X |
| 3,195,173 | 7/1965 | McNay et al. | 49/249 X |

*Primary Examiner*—Philip C. Kannan

*Attorney, Agent, or Firm*—Christensen, O'Connor, Johnson & Kindness

[57] ABSTRACT

An articulated hinge having a movable pivot axis cooperates with an energy storage device for automatically opening and securing an unlatched compartment door in a first open position. Primary and secondary linking members are rotatively mounted to a support structure adjacent the interior of the compartment door opening, and are also rotatively mounted on a hinge base member. The hinge base member forms a pivot axis about which the compartment door is mounted for rotation. A coupling member is associated with the compartment door and the primary and secondary linking members. When the compartment door is rotated, the coupling member causes the primary and secondary linking members to rotate about their attachment points to the support structure and thereby causes the pivot axis of the compartment door to move along a predetermined path. The energy storage device is associated with the hinge base member and the compartment door and is capable of exerting a force on the compartment door to urge the compartment door to move from a closed position to a first open position and to maintain the compartment door in the first open position.

8 Claims, 5 Drawing Figures

ARTICULATED HINGE COOPERATING WITH AN ENERGY STORAGE DEVICE CAPABLE OF AUTOMATICALLY OPENING AND HOLDING OPEN AN UNLATCHED COMPARTMENT DOOR

BACKGROUND OF THE INVENTION

This invention relates to a hinge assembly for a compartment door that cooperates with an energy storage device. More particularly, the invention relates to an articulated hinge assembly having a movable pivot axis that cooperates with an energy storage device capable of automatically opening and holding open an unlatched compartment door.

The design of a compartment door or adjacent surrounding structure may not provide sufficient clearance for the compartment door to rotate about a stationary pivot axis when being opened. To provide sufficient clearance between a compartment door and surrounding structure, it is necessary that the pivot axis of the compartment door move as the compartment door is rotated. This problem is particularly pertinent to passenger overhead storage compartments having upwardly opening doors and located above the seats in an airplane. The upper portion of the overhead compartment door is so close to the ceiling panels of the airplane and is so constructed that insufficient clearance exists between the upper surface of the compartment door and the ceiling panel to allow the compartment door to be opened about a stationary pivot axis. The pivot axis of the compartment door must move in a direction outboard from the compartment when the compartment door is opened to allow sufficient clearance.

It is desirable to provide a hinge apparatus for an airplane overhead compartment door that will automatically rotate the door to and support the door in a first open position when the door is unlatched. For the safety of airplane passengers, it is very important that all overhead compartment doors be latched during flight. If the compartment door is unlatched and the airplane banks in making a steep turn, an item stored in the overhead compartment could force the compartment door open and could fall onto and possibly injure passengers in the airplane. Without a mechanism for auotmatically opening an unlatched compartment door, and for supporting the door in a first open position, it is difficult to determine whether a compartment door is in a latched or unlatched condition. Force is required to achieve this result and is translated to the hinge assembly, thereby placing the hinge assembly in a constantly stressed condition.

Hinge assemblies for compartment doors having a movable pivot axis are well-known in the prior art. For example, linking members pivotally connected to a compartment door and having either the pivot point or the linking member slidably mounted in a slot have been disclosed. In these devices, one or more of the linking members or the pivot point of the compartment door slides within the slot and thereby causes the pivot point of the compartment door to move when the door is rotated. However, these prior art hinge assemblies are unsatisfactory for use with an airplane compartment door because they fail to maintain quality required in airplane structures when subjected to stress. To meet airplane standards of quality, the slot of the prior art hinge assemblies must be made of substantially friction-free material and must be manufactured to close tolerances. The pins or rollers that attach to the linking members or to the pivot point of the compartment door and that slide in the slots of the prior art hinge assemblies must be able to move in substantially friction-free relationship along the longitudinal direction of the slot, and must also be restricted from movement in any other direction. It is difficult to maintain acceptable tolerances in the slot for any substantial period of time due to normal wear between the slots and their respective pins or rollers. As the slots wear out, the compartment door becomes more susceptible to wobbling and rattling when opened and thus fails to meet the requisite quality standards.

Another prior art hinge assembly that moves the pivot axis of the compartment door when the compartment door is rotated is known as a Sepa hinge. The Sepa hinge consists of a plurality of pivotally connected linking members and support members and resembles a standard door hinge. The Sepa hinge is very bulky and heavy. If installed in an airplane overhead compartment, the Sepa hinge would occupy a considerable amount of space within the compartment. Moreover, the bulk and weight of the Sepa hinge make it difficult to combine the Sepa hinge with a mechanism for exerting a force on the compartment door to automatically open and hold the door when the compartment door is unlatched. Also, the attachment points of the linking members to the support members and to other linking members in the Sepa hinge are nonreleasable and therefore prevent removal of the compartment door. Without being able to remove or lower the compartment door from its pivot axis, it is not possible to gain access to and remove the ceiling panels of the airplane. Maintenance and repair of airplanes requires that the ceiling panels be removable.

Therefore, it is an object of this invention to provide a new and improved hinge assembly that will smoothly and efficiently open compartment doors and that is resistant to wear when subjected to stress.

It is a further object of this invention to provide a new and improved compartment door hinge assembly that has a movable pivot axis and that cooperates with a mechanism capable of exerting a force on a compartment door to automatically open and hold open an unlatched compartment door.

It is yet another object of this invention to provide a new and improved compartment door apparatus, including a door hinge assembly cooperating with an energy storage device, that is lightweight and small so that the entire apparatus may be mounted within a compartment without occupying much internal space.

It is yet another object of this invention to provide a new and improved compartment door hinge assembly cooperating with an energy storage device that can be partially disconnected to allow the compartment door to be lowered, providing quick and easy access to the ceiling panels in an airplane, and that can be quickly and easily reconnected.

SUMMARY OF THE INVENTION

In accordance with this invention, an articulated hinge having a movable pivot axis, cooperates with an energy storage device capable of automatically opening and holding open an unlatched compartment door. The apparatus includes a hinge base member, a plurality of linking members, a mechanism for rotatably mounting the compartment door to the hinge base member, a coupling member and an energy storage device. The plurality of linking members are mounted for rotation on the hinge base member. The linking members have axes of rotation that are mutually parallel. The compartment door is rotatively mounted to the hinge base member which has an axis of rotation that is parallel with the axes of rotation of the plurality of linking members. When common ends of the linking members are rotatively affixed to a support member, the coupling member causes at least one of the plurality of linking members to rotate about its attachment point with the support member, thereby causing the axis of rotation of the compartment door to move along a predetermined path as the compartment door is rotated about the axis of rotation of its mounting means. The energy storage device is associated with the hinge base member and the mounting means so as to exert a force on the compartment door to urge the compartment door to rotate from its closed position to a first open position, and to maintain the compartment door in the first open position.

In accordance with further aspects of this invention, by varying the orientation of the energy storage device with respect to the hinge base member, the force exerted on the mounting means for the compartment door to urge the door to its first open position is increased to compensate for the weight of the door as it swings upwardly. Also, by varying the orientation of the energy storage device, the compartment door can be made to assume a variety of open positions depending upon the extent to which surrounding structure allows rotation of the compartment door.

In accordance with still further aspects of this invention the apparatus includes a quick release mechanism for disconnecting the compartment door from the hinge base member at the axis of rotation of the compartment door. The compartment door remains partially connected to the apparatus and the compartment door may be lowered to allow access to areas adjacent the axis of rotation of the compartment door that were previously inaccessible.

It will be appreciated from the foregoing brief summary that the invention provides a new and improved hinge that will smoothly and efficiently open compartment doors and that are resistant to wear when subjected to stress. The apparatus is lightweight and small so that the entire apparatus may be mounted within the compartment without occupying much internal space. Further, the apparatus insures that the compartment doors are latched in a closed position for the safety of passengers and/or equipment.

BRIEF DESCRIPTION OF THE DRAWINGS

The foregoing objects and many of the attendant advantages of this invention will become more readily appreciated with reference to the following detailed description and accompanying drawings wherein.

DESCRIPTION OF THE PREFERRED EMBODIMENT

FIGS. 1 through 5 illustrate the preferred embodiment of this invention when used in conjunction with an airplane overhead storage compartment. As best shown in FIGS. 2 through 5, the overhead compartment door 15 and the airplane ceiling panel 16 are constructed and positioned so that the compartment door 15 cannot be rotated to an open position about a stationary pivot axis without being obstructed by the ceiling panel 16. The hinge assembly of this invention provides a pivot axis for the compartment door 15 that follows a circular path about a central point CR on the exterior of the compartment. An energy storage device 70, e.g., a gas spring (available under the trademark GAS SPRING from Gas Spring Corp. of Montgomerysville, PA) cooperates with the hinge assembly to exert a biasing force on the compartment door to automatically move the compartment door from a closed position to an open position when the door is unlatched, and also to hold the compartment door in the open position. The compartment door must be manually moved back to the closed position.

Figure 1:
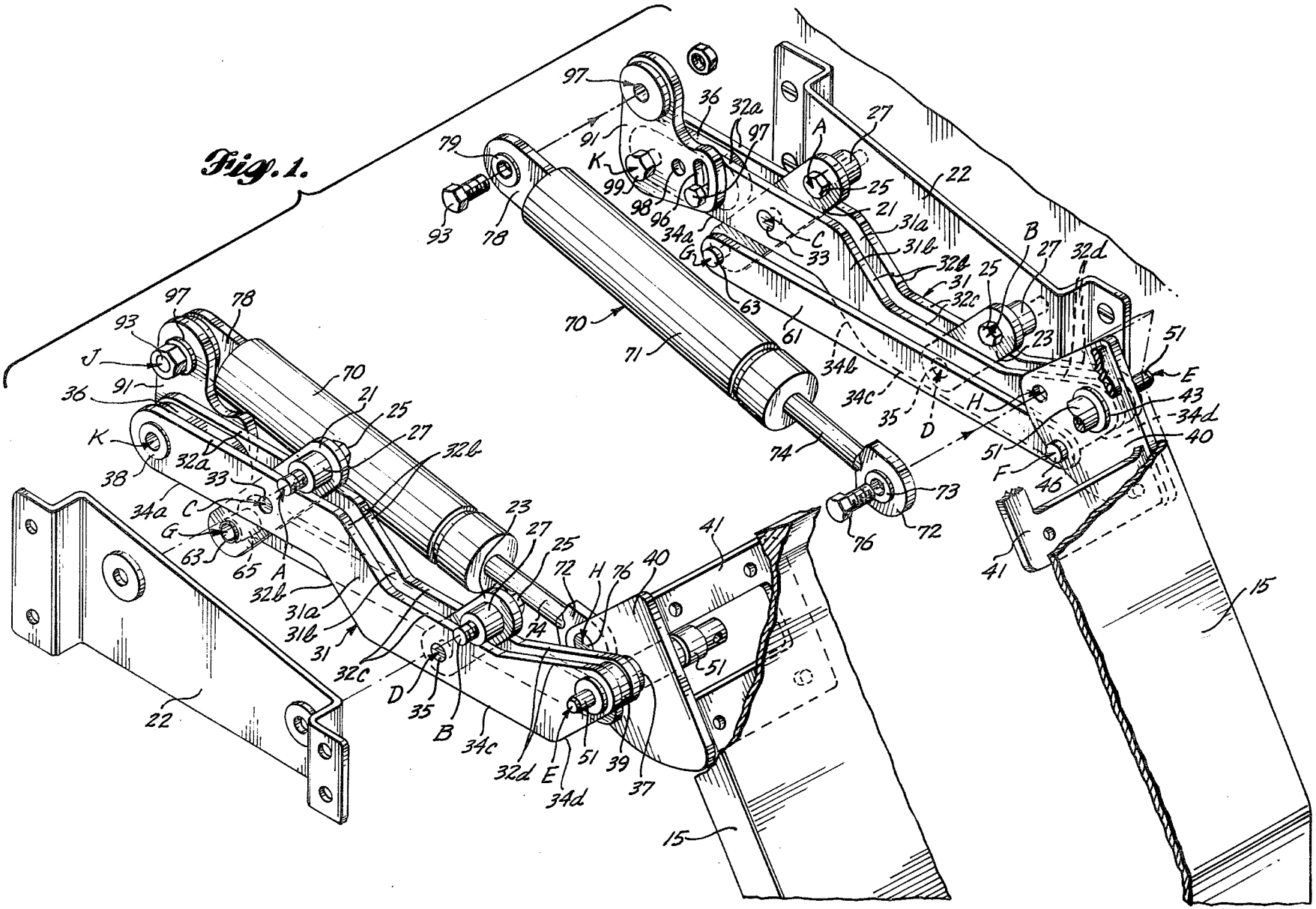
FIG. 1 is an isometric view of the hinge assembly, partially broken away, rigidly affixed to a compartment door (partially broken away), and the energy storage device in an assembly view of the present invention.

Referring to FIG. 1, two hinge assemblies are provided from each overhead compartment door 15. Each hinge assembly is attached adjacent opposite edges of the compartment door 15 and consists of a primary link member 21, a secondary link member 23, a hinge base member 31, a hinge rotation plate 40, a coupling bar 61 and a riser coupling bar 91. Briefly, the hinge rotation plate 40 is affixed to the compartment door 15, and the hinge base member 31, coupling bar 61 and energy storage device 70 are associated with both the hinge rotation plate 40, and the primary and secondary link members 21 and 23. When the compartment door 15 is unlatched, an energy storage device 70 cooperates with the hinge assembly to urge the compartment door 15 to a first open position and the entire hinge assembly rotates about attachment points A and B of the primary and secondary link members 21 and 23 to a support member 22. By varying the orientation and/or position of the energy storage device 70 with respect to the hinge base member 31, the compartment door 15 may be opened to different positions and the amount of biasing force exerted by the energy storage device 70 on the compartment door 15 may be varied. A releasable ball lock pin 51 connects the hinge rotation plate 40 with the drive member 31 and acts as the pivot axis for the compartment door 15. The releasable ball lock pin 51 may be readily removed to partially disconnect the hinge assembly, with allows the compartment door to be lowered to permit access to the ceiling panels 16. See FIG. 5.

The primary link member 21 and secondary link member 23 are elongate bars rotatively attached at their upper ends to a support plate 22 by sleeved bolts 25. The support plate 22 is affixed to the side of the overhead compartment and has a planar outer surface. (For purposes of describing the preferred embodiment of this invention, the "outer surface" is that surface that is farthest away from the side of the overhead compartment, and the "inner surface" is that surface closest to the side of the overhead compartment. Also, "forward" is the direction toward the compartment door 15 and "rearward" is the direction away from the compartment door 15.) A tapped opening for the secondary link member 23 (attachment point "B") is positioned forwardly and downwardly from the tapped opening of the primary link member 21 (attachment point "A"). Spacer washers 27 are mounted on the sleeved bolts 25 between the inner surfaces of the linking members 21 and 23 and the outer surface of the support plate 22 so that a portion of the hinge base member 31 (explained in detail below) can move without interference between the linking members 21 and 23 and the support plate 22. The sleeved bolts 25 are tightened in the tapped opening on the support plate 22.

Figure 2:
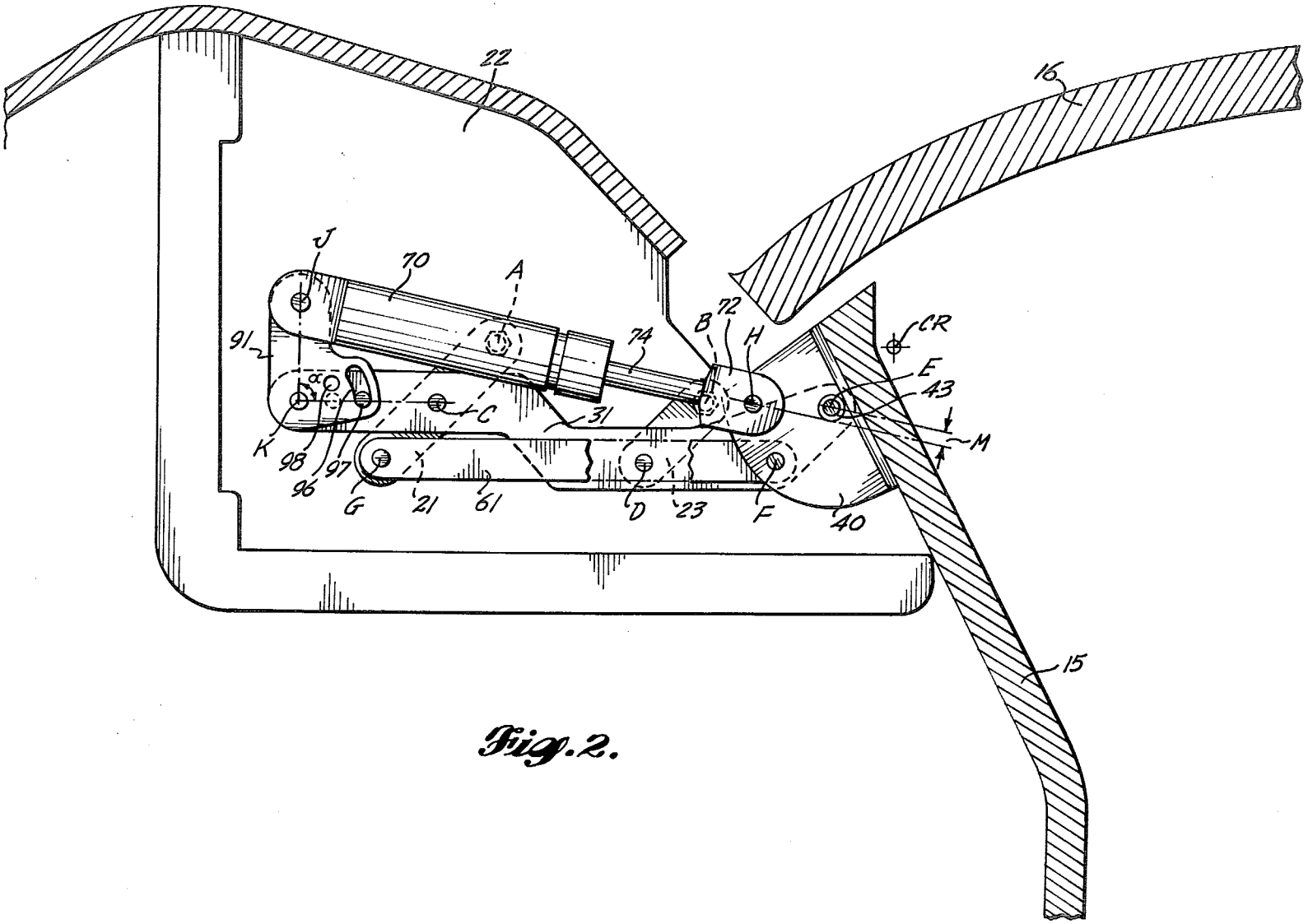
FIG. 2 is a side elevation view of the apparatus of the present invention wherein the compartment door is in a closed position.
Figure 3:
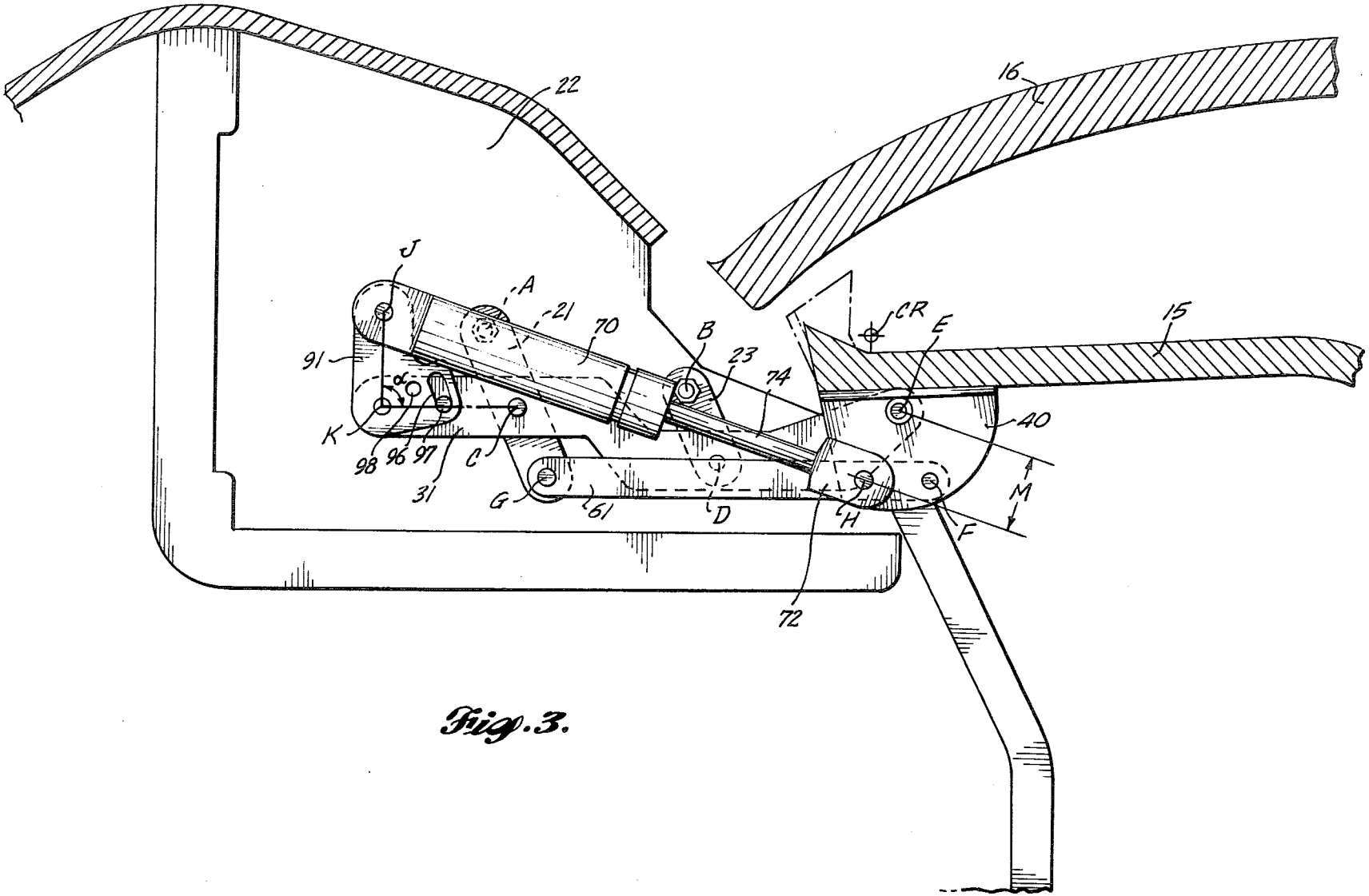
FIG. 3 is a side elevation view of the apparatus of the invention wherein the compartment door is in a first open position.
Figure 4:
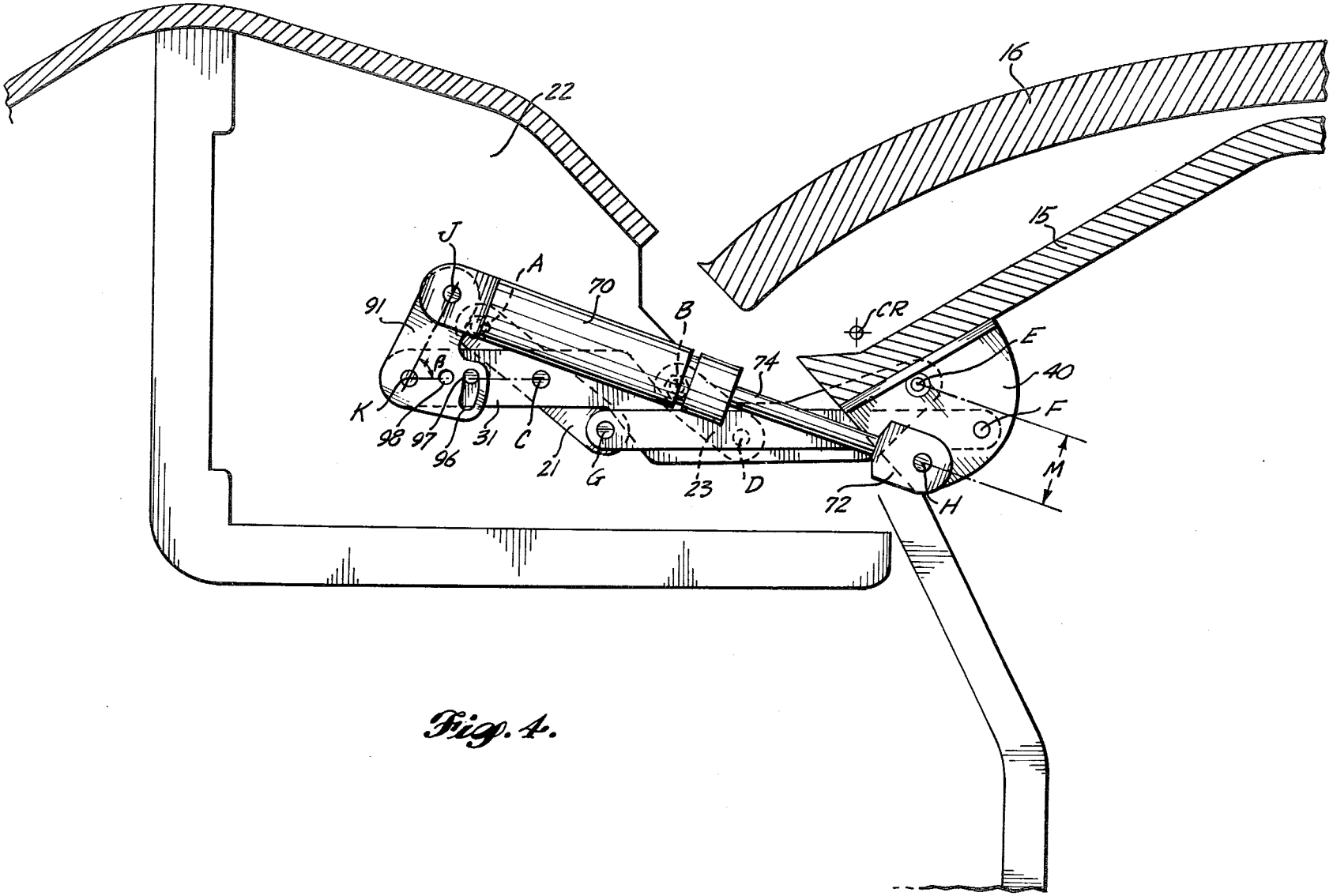
FIG. 4 is a side elevation view of the apparatus of the invention wherein the compartment door is in a second open position.

The primary link member 21 and secondary link member 23 are also rotatively mounted on a hinge base member 31. The hinge base member 31 consists of a pair of identically shaped, parallel, spaced apart, elongate bars 31*a* and 31*b*. The upper surface 32 of the hinge base member 31 has four sections starting from the rearward end: a first horizontally oriented section 32*a*, a declining second 32*b*, a second horizontally oriented section 32*c*, and an inclining section 32*d*. The bottom surface of the hinge base member 31 parallels the upper surface with the exception that the second horizontally oriented section 34*c* of the bottom surface continues forwardly so that the inclining section 34*d* of the bottom surface is steeper than the inclining section 32*d* of the upper surface. The primary link member 21 extends between bars 31*a* and 31*b* of hinge base member 31, and is mounted for rotation at its midpoint on pin 33 (attachment point "C"). The pin 33 is affixed to the hinge base member 31 and is positioned between the first horizontally oriented sections 32*a* and 34*a* of the upper and bottom surface of the hinge base member 31. The secondary link member 23, adjacent to the end opposite attachment point B, is mounted for rotation on the hinge base member 31 between bars 31*a* and 31*b* on pin 35 (attachment point "D"). Pin 35 is located between the second horizontally oriented sections 32*c* and 34*c* of the upper and bottom surfaces of hinge base member 31. The distance between the centers of attachment points A and C and between the centers of attachment points B and D are equal. Therefore, any point on the hinge base member 31 rotates about a center of rotation having a position parallel with a line defined by the centers of either attachment points A and C, or attachment points B and D, and having a length from the upper surface of the hinge base member 31 on the line from the specific point equal to the length between the centers of attachment points A or B and the upper surface of the hinge base member. Therefore, the horizontally oriented sections 32*a*, 32*c*, 34*a* and 34*c* of the hinge base member 31 remain horizontal as the compartment door is rotated to its first and second open positions. See FIGS. 2, 3 and 4. Also, the angle of inclining and declining sections 32*b*, 32*d*, 34*b* and 34*d* with respect to the horizontally oriented sections 32*a*, 32*c*, 34*a* and 34*c* of the upper and bottom surfaces of the hinge base member 31, and the position of attachment points C and D of the primary and secondary link member 21 and 23 are regulated so that the primary and secondary link members 21 and 23 may rotate without interference with respect to the hinge base member 31 when the compartment door 15 rotates from its first or closed position (as shown in FIG. 2) to its second open positions (as shown in FIGS. 3 and 4, respectively). Furthermore, the shape of the hinge base member 31 allows access to sleeved bolts 25 when the hinge assembly is mounted within the overhead compartment.

To maintain a constant spacial distance between bars 31*a* and 31*b* of the hinge base member 31, a spacer bar 36 and a spacer washer 39 are mounted between and affixed to bars 31*a* and 31*b* adjacent its rearward end and the forward end, respectively, of the hinge base member 31. A sleeve 38 extends through and is retained within openings in the spacer bar 36 and bars 31*a* and 31*b*, adjacent the rear end of hinge base member 31 to receive a bolt for rotative mounting the riser coupling bar 91 on the hinge base member 31 (attachment point "K"). Similarly, a sleeve 37 for receiving a releasable ball lock pin 51 extends through and is retained within openings in bars 31*a* and 31*b* and spacer washer 39 at the forward end of hinge base member 31 for rotatively mounting the hinge rotation plate 40 to hinge base member 31 (attachment point "E"). When the compartment door is in a closed position, as shown in FIG. 2, attachment points K, C, B and E form a horizontal reference frame, which simplifies the installation of the hinge assembly.

The center of attachment point B of the secondary link member 23 is spaced away from a line formed by the centers of attachment point A of the primary link member 21 and attachment point E. By offsetting attachment point B in this manner, the hinge assembly becomes more resistant to torsional stresses. As the compartment door 15 is rotated to the first or second open positions, as shown in FIGS. 3 and 4, the distance between the center of attachment point B and the line formed by the centers of attachment point A and E increases; thereby increasing the torsional stability of the hinge assembly.

The hinge rotation plate 40 is mounted for rotation on hinge base member 31 at attachment point E. When the hinge rotation plate 40 is affixed to the compartment door 15, attachment point E becomes the pivot axis for the compartment door 15. An opening extends through the hinge rotation plate 40 adjacent its forward surface (when the compartment door 15 is in a closed position as viewed in FIG. 2) and is fitted with a self-aligning sleeve 43. The inner surface of the hinge rotation plate 40 is spaced away from the outer surface of the hinge base member 31, and the releasable ball lock pin 51 is inserted through the sleeves 43 and 37.

As shown in FIG. 1, adjacent the forward surface of the hinge rotation plate 40, a fastening plate extension 41 is integral with and projects outwardly orthogonal to from the outer surface of the hinge rotation plate 40 to abut against the rearward surface of the compartment door 15. The compartment door 15 is rigidly affixed to the fastening plate extension 41 of the hinge rotation plate 40.

One end of a straight, elongate coupling bar 61 is mounted for rotation on the inner surface of hinge rotation plate 40 on pin 46 (attachment point "F"). As best viewed in FIGS. 2, 3 and 4, the distance between the centers of attachment points E and F equals the distance between the centers of attachment points A and C and between the centers of attachment points B and D. The opposite end of coupling bar 61 is mounted for rotation on the outer surface of the end of the primary link member 21 opposite attachment point A on connecting pin 63 (attachment point "G"). The distance between the centers of attachment points C and G is equal to the distance between the centers of attachment points A and C, B and D, and E and F. Therefore, the coupling bar 61 always maintains a horizontal orientation as the compartment door 15 moves to its first or second open positions. A spacer washer 65 is mounted on connecting pin 63 between the inner surface of the coupling bar and the outer surface of the primary link. The coupling bar 61 is therefore spaced away from both the outer surface of the hinge rotation plate 40 and the inner surface of hinge base member 31 predetermined distances so that the coupling bar 61 moves without obstruction. Referring to FIGS. 2–4, when the compartment door 15 is rotated about its pivot axis, the releasable ball lock pin 51, attachment point F also rotates about the pivot axis. This results in the movement of the coupling bar 61 and causes the primary link member 21 to rotate about attachment point A; thereby rotating the hinge base member 31 about attachment points A and B. The releasable ball lock pin 51 follows a circular path having a center of rotation CR located on a line formed by centers of attachment points E and F and at a distance from the center of attachment point E equal to the distance between the centers of attachment points E and F. This interaction is described in more detail below.

The hinge rotation plate 40 is spring loaded to positions corresponding to either a first or a second open position of the compartment door by an energy storage device. The first and second open positions of the compartment door 15 are shown in FIGS. 3 and 4, respectively. Preferably, the energy storage device 70 is a gas spring that exerts an opening and hold open force on the hinge rotation plate 40, and includes a cylinder 71, an axial piston rod 74 extending through the end of the cylinder 71, and a piston (not shown), slidable with the cylinder 71 and affixed to the end of the piston rod 74 within the cylinder 71. When the piston rod 74 is fully extended, as shown in FIGS. 3 and 4, the energy storage device 70 resists a rearward movement of the piston rod 74. As the piston rod 74 is retracted into the cylinder, a biasing force within the cylinder 71 of the energy storage device 70 urges the piston rod toward its extended position and is gradually increased as the piston rod 74 is further retracted. A fastening flange 72 is welded to the end of the axial piston rod 74 of the energy storage device 70. Fastening flange 72 is mounted for rotation adjacent the outer surface of the hinge rotation plate 40 on connecting bolt 76 (attachment point "H") which extends through a sleeved opening 73 in the fastening flange 72 and an opening in the hinge rotation plate 40. The opening on the hinge rotation plate for receiving the connecting pin 76 is located rearwardly of attachment point F. Spacer washers (not shown), if needed, may be mounted on bolt 76 between the fastening plate 72 of the energy storage device 70 and the outer surface of the hinge rotation plate 40 so that the piston rod 74 of energy storage device 70 may move without interference with respect to hinge rotation plate 40. A second fastening flange 78 is affixed to and projects rearwardly, orthogonal from the end of the cylinder 71 opposite the piston rod 74. The second fastening flange 78 is fitted with a sleeved opening 79 and is mounted for rotation adjacent the outer surface of the riser coupling bar 91 on bolt 93 (attachment point "J"), which extends through a sleeved opening 97 in the riser coupling plate 91 adjacent its upper surface and sleeved opening 79. The riser coupling plate 91 is also fitted with a second sleeved opening (not shown) and is rotatively mounted to the outer surface of the hinge base member 31 adjacent its rearward end on bolt 99 (attachment point "K"), which extends through sleeved openings 38 and the second sleeved opening in the riser coupling bar 91. The biasing force exerted by the energy storage device 70 on the compartment door 15 to urge the door 15 to its open position is dependent upon a moment arm M defined by the distance between the center of attachment point E and a line formed by the centers of attachment points H and J. See FIG. 2. This moment arm M increases in length as the compartment door is rotated to the first open position, as shown in FIG. 3, and to the second position, as shown in FIG. 4. For an overhead compartment door having a length of 60 inches, and using 35 pound GAS SPRINGS as the energy storage device, the biasing force exerted on the compartment door in the closed position is approximately 2 pounds and the hold open force exerted by the GAS SPRINGS to resist closure of the compartment door 15 when the door 15 is in the first or second open positions, is approximately 5 pounds. The biasing force and hold open force exerted by the energy storage device 70 on the compartment door 15 may be modified by varying the locations of attachment points E, H, J and K. For example, if attachment point J is moved closer to attachment point K, then the length of moment arm M would be decreased and therefore the opening biasing force exerted by the energy storage device 70 on compartment door 15 would decrease (the hold open force would remain constant). If attachment point H is moved closer to attachment point F, then the length of moment arm M would be increased when the compartment door is in the closed position and therefore the opening biasing force exerted by the energy storage device 70 on the compartment door 15 would be increased (the hold open force would decrease). Preferably, to maintain the 2 pound opening biasing force and the 5 pound hold open force for smaller compartment doors, attachment point H is moved toward attachment point E when the compartment door is in the closed position (FIG. 2) so that the length of moment arm M is decreased when the compartment door is in both the open and closed position. As previously described, it is desirable to spring load the hinge rotation plate 40 to the open position so that if the compartment door 15 is not latched in a closed position, it will automatically rotate to an open position. However, if desired, the hinge rotation plate 40 may be biased to the closed position by creating a moment arm M that is above attachment point E.

In an airplane, such as the Boeing 727, the ceiling panels are configured such that two open positions are required for overhead compartment doors 15. In one section of the airplane, the ceiling panels will allow the compartment door to open to a first open position, whereas in other parts of the airplane, the ceiling panels allow the compartment doors to further open to a second open position of greater extension than the first open position. However, in areas of the airplane which allow the compartment door 15 to be opened to the second open position, it may be desirable, for reasons of passenger accessibility, to allow the compartment door 15 to open to the first position, and to provide a mechanism that allows the compartment door to be further rotated without damage to the hinge assembly. The open position of the compartment door 15 is dependent upon the extent to which the piston rod 74 is retracted within cylinder 71 when attachment point H remains fixed. For example, when the angular position of attachment point J with respect to attachment point K and a line formed by attachment points K and C is defined by angle $\alpha$, the piston rod 74 will extend a predetermined distance from the cylinder 71 so that the compartment door opens to the first open position. See FIG. 3. If angle $\alpha$ is decreased to angle $\beta$, as shown in FIG. 4, then the retraction of the piston rod into the cylinder of the energy storage device 70 is increased, the piston rod 74 moves a greater distance to its extended position and the compartment door further rotates to the second open position. Angles $\alpha$ and $\beta$ could be fixed by inserting a set-screw 97 through an opening 98 in the riser coupling plate 91 and tightening the set-screw 97 within a tapped opening in the hinge base member 31. The riser coupling plate 91 is then rigidly held in a position with respect to the hinge base member 31. As an alternative, a circular slot 96 having a center coincident with the center of attachment point K can extend through the riser coupling plate 91. The set-screw 97 is tightened into a tapped opening in the hinge base member 31 such that the set-screw abuts the lower portion of the slot 96. The center of attachment point J is positioned at the angle $\alpha$, as described above and shown in FIG. 3. When the compartment door is opened to the first open position, the set-screw remains adjacent the lower portion of the slot 96. If the compartment door is jarred upwardly, then the riser coupling plate rotates about attachment point K until the set-screw abuts the upper portion of slot 96. The center of attachment point J is now positioned at the angle $\beta$ described above and shown in FIG. 4.

Figure 5:
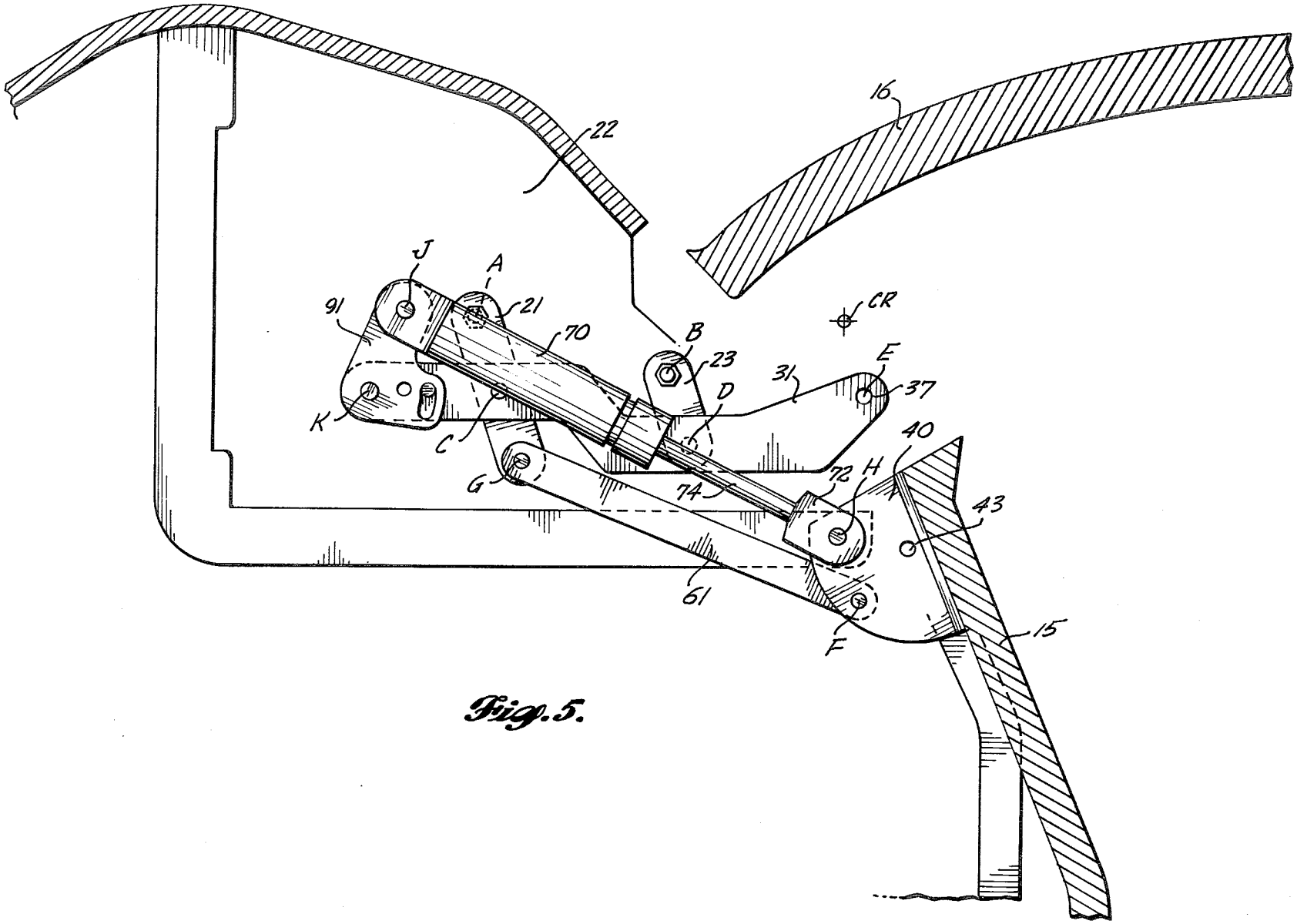
FIG. 5 is a side elevation view of the apparatus of the invention wherein the compartment door is partially disconnected from the apparatus.

Referring to FIG. 5, if access to the ceiling panel 16 is required, hinge rotation plate 40 is disconnected from the hinge base member 31 by removing the releasable ball lock pin 51. The hinge rotation plate 40 is still connected to the hinge assembly via the coupling bar 61 and energy storage device 70. The compartment door is moved down and away from the ceiling panel 16 upon removal of the releasable ball lock pin 51 to provide access to the ceiling, but can be quickly and easily reinstalled by inserting the releasable ball lock pin 51 through the sleeved openings 44 and 37 of the hinge rotation plate 40 and hinge base member 31, respectively.

The combined energy storage device and hinge assembly, illustrated and described in the preferred embodiment of this invention, are designed to occupy as little space within the overhead compartments as possible. All inner and outer surfaces of the primary link member 21, secondary link member 23, hinge base member 31, hinge rotation plate 40, coupling bar 61, riser coupling bar 91 and the first and second fastening flanges 72 and 76 of the energy storage device 70 are planar and parallel with the outer surface of the support plate 22. Also, the axis of rotation of attachment points A, B, C, D, E, F, G, H, J and K is orthogonal to the planar outer surface of the support plate 22. Additionally, friction reducing washers are used with all attachment points so that rotation of the appropriate components of the hinge assembly is substantially friction-free. For example, friction reducing spacer washers (not shown) are mounted on the pins 33 between the bars 31*a* and 31*b* and the primary link 21.

When the compartment door 15 is in a closed position, as shown in FIG. 2, the center of attachment point A is 1 inch away from the center of attachment point C and the line formed by the centers of attachment points A and C is approximately 47° from a reference frame defined by the centers of attachment points K, C and E. The center of attachment point E is 1 inch away from the center of attachment point F and the line through the centers of attachment points E and F is approximately 47° from a reference frame defined by the centers of attachment points G and F. The center of attachment point B is 1 inch away from the center of attachment point D and the line formed by the centers of attachment points B and D is approximately 47° from a reference plane parallel with the reference plane mentioned above running through the center of attachment point D. Therefore, the center of rotation CR is 1 inch away from the center of attachment point E (the hinge point) and the line through CR and the center of attachment point E is angled approximately 47° from the reference plane through the centers of attachment points K, C and E. When the center of attachment point J is approximately 90°, and the center of attachment point H is approximately 1 inch away from the center of attachment point E and a line formed by the centers of attachment points H and E is approximately 47 radians rearward of a line formed between the centers of attachment points E and F, the moment arm M of the energy storage device 70 with respect to attachment point E is approximately 0.18 inches. Also, the center of attachment point B is approximately 0.1 inch below a line formed between the center of attachment points A and E. When the compartment door 15 is rotated to the first open position, as shown in FIG. 3, the center of rotation CR is angled from a reference plane formed by the centers of attachment points K, C and E by approximately 112°. The length of moment arm M is approximately 0.83 inches. The center of attachment point B is approximately 0.21 inches below a line formed between the centers of attachment points A and E. When the compartment door 15 is opened to the second open position, as shown in FIG. 4, the riser coupling plate 91 rotates about the center of attachment point K. Angle $\beta$ is approximately 65°. The center of rotation of the compartment door CR is still 1 inch away from the center of attachment point E, and a line formed by the center of attachment point E and the center of rotation CR is approximately 138° from the reference plane formed by the centers of attachment points K, C and E. The length of moment arm M is approximately 0.82 inches. The center of attachment point B is approximately 0.33 inches below a line formed between the centers of attachment points A and E.

It will be appreciated from the foregoing description that the combined power storage device and hinge assembly formed in accordance with this invention automatically moves a compartment door to an open position about a center of rotation exterior to the compartment. The apparatus is compact so that it occupies very little space within the compartment, and yet opens a compartment door smoothly and efficiently. All of the attachment points of the apparatus are readily accessible for easy installation and maintenance.

While a preferred embodiment has been illustrated and described, it will be appreciated by those skilled in the art and others that various changes can be made without departing from the spirit and scope of the invention. For example, the first fastening flange 72 of the energy storage device 70 and the coupling bar 61 may be rotatably attached to a flange that is affixed to the compartment door 15 rather than to the hinge rotation plate 40. Further, the length between the centers of attachment points A and C, B and D, C and G, E and F, may be varied so that the pivot axis, attachment point E, will follow an arcuate path, i.e., elliptical or parabolic, or even a straight line path. Moreover, different energy storage devices may be used as substitutes for the energy storage device. Hence, the invention may be practiced otherwise than is specifically described herein.

The embodiments of the invention in which an exclusive property or privilege is claimed are defined as follows:

1. An articulated hinge apparatus having a movable pivot axis cooperating with an energy storage device capable of automatically opening and holding open an unlatched compartment door comprising:

a support member;

a hinge base member;

a plurality of linking members mounted for rotation on said support member and on said hinge base member, said linking members having axes of rotation that are mutually parallel, the axes of rotation of said linking members relative to said support member being spaced from the axes of rotation of said linking members relative to said hinge base member;

first mounting means associated with said hinge base member and said compartment door for rotatively mounting said compartment door on said hinge base member about an axis of rotation parallel with the axes of rotation of said plurality of linking members;

coupling means associated with said plurality of linking members and said compartment door for rotating at least one of said plurality of linking members relative to said support member, whereby the axis of rotation of said first mounting means moves along a predetermined path as said compartment door is rotated about said axis of rotation of said first mounting means; and an energy storage device associated with said hinge base member and said compartment door, said energy storage device being operable to exert a force on said compartment door for urging said compartment door to rotate from a closed position to a first open position, and for maintaining said compartment door in said first position.

2. The apparatus of claim 1 wherein said force exerted on said compartment door increases as said compartment door rotates from said closed position to said first open position.

3. The apparatus of claim 2 wherein the force exerted on said compartment door is increased by varying the orientation of said energy storage device with respect to said hinge base member.

4. The apparatus of claim 3 wherein, by varying the orientation of said energy storage device with respect to said hinge base member, the open position of said compartment door is varied.

5. The apparatus of claims 1, 2 or 4 wherein said plurality of linking members includes at least a primary linking member and a secondary linking member, said primary and secondary linking members being mounted for rotation on said support member and having axes of rotation relative to said support member parallel with said axes of rotation of said linking members relative to said hinge base member, said secondary linking member being configured and mounted on said support member and said hinge base member to provide stability for said apparatus.

6. The apparatus of claim 5 wherein said secondary member is located between said primary linking member and said first mounting means, the axis of rotation of said secondary member relative to said support member being spaced from a line extending through the axes of rotation of said primary member relative to said support member and said first mounting means, the spaced relation between said line and the axis of rotation of said secondary member relative to said support member increasing as said compartment door is opened.

7. The apparatus of claim 1 including second mounting means for rotatively mounting said energy storage device to said hinge base member, said energy storage device being mounted for rotation on said second mounting means, said apparatus further comprising means associated with said hinge base member and said energy storage device for allowing further rotation of said compartment door from said first open position to a second open position.

8. The apparatus of claim 7 wherein said predetermined path is a circular path, said circular path having a center point located on a first line extending through said axis of rotation of said first mounting means relative to said hinge base member, said first line being parallel with a second line extending through said axes of rotation of said primary linking member relative to said support member and said hinge base member, said center point being spaced outwardly from said compartment door and being spaced from said axis of rotation of said first mounting means relative to said hinge base member by a distance equal to the distance between said axes of rotation of said primary linking member.

* * * * *

UNITED STATES PATENT AND TRADEMARK OFFICE

CERTIFICATE OF CORRECTION

PATENT NO. : 4,185,415

DATED : January 29, 1980

INVENTOR(S) : Richard J. LaConte

It is certified that error appears in the above-identified patent and that said Letters Patent are hereby corrected as shown below:

Column 11, line 44: "first position" is changed to —"first open position".

Column 12, line 28: "claim 1" is changed to — "claim 6".

Signed and Sealed this

*Eighth* Day of *July 1980*

[SEAL]

*Attest:*

SIDNEY A. DIAMOND

*Attesting Officer*

*Commissioner of Patents and Trademarks*